US009653819B1

(12) United States Patent
Izadian

(10) Patent No.: US 9,653,819 B1
(45) Date of Patent: May 16, 2017

(54) WAVEGUIDE ANTENNA FABRICATION

(71) Applicant: Google Inc., Mountain View, CA (US)

(72) Inventor: Jamal Izadian, San Jose, CA (US)

(73) Assignee: Waymo LLC, Mountain View, CA (US)

( * ) Notice: Subject to any disclaimer, the term of this patent is extended or adjusted under 35 U.S.C. 154(b) by 339 days.

(21) Appl. No.: 14/450,545

(22) Filed: Aug. 4, 2014

(51) Int. Cl.
*H01Q 21/20* (2006.01)
*H01Q 21/00* (2006.01)

(52) U.S. Cl.
CPC ..... *H01Q 21/20* (2013.01); *H01Q 21/0087* (2013.01)

(58) Field of Classification Search
CPC ..... H01Q 21/24
USPC ..... 343/771
See application file for complete search history.

(56) References Cited

U.S. PATENT DOCUMENTS

| | | | | |
|---|---|---|---|---|
| 3,696,433 | A | 10/1972 | Killion | |
| 5,565,878 | A | 10/1996 | Lagerlof | |
| 5,596,336 | A | 1/1997 | Liu | |
| 6,185,354 | B1 | 2/2001 | Kronz | |
| 6,232,910 | B1 | 5/2001 | Bell et al. | |
| 6,243,024 | B1 | 6/2001 | Yamabuchi et al. | |
| 6,297,782 | B1 | 10/2001 | Matthews | |
| 6,563,398 | B1 | 5/2003 | Wu | |
| 6,642,908 | B2 | 11/2003 | Pleva et al. | |
| 7,202,832 | B2 | 4/2007 | Wang | |
| 7,423,604 | B2 | 9/2008 | Nagai | |
| 7,450,072 | B2 | 11/2008 | Kim | |
| 7,576,703 | B1 | 8/2009 | Herting et al. | |
| 7,783,403 | B2 | 8/2010 | Breed | |
| 7,928,919 | B2 | 4/2011 | Margomenos | |
| 8,013,694 | B2 | 9/2011 | Hiramatsu | |
| 8,134,427 | B2 | 3/2012 | Fujita | |
| 2006/0000915 | A1* | 1/2006 | Kodukula | G06K 19/07749 235/492 |
| 2007/0013598 | A1 | 1/2007 | Artis et al. | |
| 2009/0121952 | A1 | 5/2009 | Shibuya et al. | |
| 2009/0300901 | A1 | 12/2009 | Artis et al. | |
| 2010/0085263 | A1 | 4/2010 | Yano | |
| 2010/0238085 | A1* | 9/2010 | Fuh | H01Q 13/22 343/771 |
| 2011/0291874 | A1 | 12/2011 | De Mersseman | |
| 2013/0141186 | A1 | 6/2013 | Nguyen et al. | |
| 2013/0236189 | A1 | 9/2013 | Yamamoto et al. | |

(Continued)

*Primary Examiner* — Graham Smith
*Assistant Examiner* — Andrea Lindgren Baltzell
(74) *Attorney, Agent, or Firm* — McDonnell Boehnen Hulbert & Berghoff LLP

(57) ABSTRACT

An example method of fabricating a waveguide antenna may involve providing a first metal layer with waveguide channels formed therein. The method may also involve selecting at least one coupling surface on the first metal layer that is proximate to at least edges of the waveguide channels. The method may also involve removing respective oxidation layers from second and third metal layers. The method may also involve providing, to the selected at least one coupling surface, a fusible metal material and a reactive metal foil between surfaces of the first and second metal layers and between surfaces of the first and third metal layers. The method may also involve coupling the layers together by igniting the reactive metal foil so as to locally provide heat to the surfaces of the layers and melt the fusible metal material, and then cooling the melted fusible metal material.

22 Claims, 6 Drawing Sheets

(56) References Cited

U.S. PATENT DOCUMENTS

| | | | | |
|---|---|---|---|---|
| 2013/0321229 | A1 | 12/2013 | Klefenz et al. | |
| 2014/0154808 | A1* | 6/2014 | Patel | G01K 3/04<br>436/1 |

* cited by examiner

WAVEGUIDE ANTENNA FABRICATION

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals.

Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to a millimeter (mm) wave electromagnetic wave length (e.g., 3.9 mm for 77 GHz). These radar systems may use antennas that can to focus the radiated energy into tight beams in order to enable the radar system to measure an environment with high accuracy, such as an environment around an autonomous vehicle. Such antennas may be compact (typically with rectangular form factors), efficient (i.e., with little of the 77 GHz energy lost to heat in the antenna or reflected back into the transmitter electronics), and low cost and easy to manufacture (i.e., radar systems with these antennas can be made in high volume).

In some scenarios, efficiency may be difficult to balance with low cost and easy manufacture. Some low cost and easy to manufacture options may involve integrating an antenna into a circuit board (e.g., with a "series-fed patch array"). However, such antennas may lose much of their energy into heating up the substrate of the circuit board. Antennas with the lowest loss may include all-metal designs. But typical all-metal antennas, such as slotted waveguide arrays, can be difficult to manufacture with the small geometries needed to support 77 GHz operation.

SUMMARY

The present application discloses embodiments that relate to methods of fabricating waveguide antennas and the waveguide antennas formed thereby. In one aspect, the present application describes a method of manufacture for an example waveguide antenna. The method may involve providing a first metal layer including one or more waveguide channels formed into the first metal layer. The method may also involve selecting, on the first metal layer, at least one coupling surface proximate to at least edges of the one or more waveguide channels. The method may further involve removing an oxidation layer from a second metal layer and from a third metal layer. The method may further involve providing a reactive metal foil between a first surface of the first metal layer and a surface of the second metal layer, and between a second surface of the first metal layer and a surface of the third metal layer, the second surface of the first metal layer being opposite the first surface, where the reactive metal foil is provided to the selected at least one coupling surface. The method may still further involve providing a fusible metal material between the first surface of the first metal layer and the surface of the second metal layer, and between the second surface of the first metal layer and the surface of the third metal layer, where the fusible metal material is provided to the selected at least one coupling surface. The method may yet still further involve coupling the first surface of the first metal layer to the surface of the second metal layer and coupling the second surface of the first metal layer to the surface of the third metal layer, where the couplings comprise igniting the reactive metal foil so as to locally provide heat to the surfaces of the first, second, and third metal layers and melt the fusible metal material, and cooling the melted fusible metal material.

In another aspect, the present application describes a waveguide antenna. The waveguide antenna may include a first metal layer including (i) one or more waveguide channels formed into the first metal layer and (ii) at least one coupling surface proximate to at least edges of the one or more waveguide channels. The waveguide antenna may also include a second metal layer and a third metal layer, each with respective oxidation layers removed. The waveguide antenna may further include a reactive metal foil that is (i) provided to the at least one coupling surface, (ii) located between a surface of the first metal layer and a first surface of the second metal layer, and (iii) located between a second surface of the first metal layer and a surface of the third metal layer, the second surface of the first metal layer being opposite the first surface. The waveguide antenna may still further include a fusible metal material that is (i) provided to the at least one coupling surface, (ii) located between the first surface of the first metal layer and the surface of the second metal layer, and (iii) located between the second surface of the first metal layer and the surface of the third metal layer, where the first surface of the first metal layer is coupled to the surface of the second metal layer and the second surface of the first metal layer is coupled to the surface of the third metal layer by: igniting the reactive metal foil so as to locally provide heat to the surfaces of the first, second, and third metal layers and melt the fusible metal material, and cooling the melted fusible metal material.

In yet another aspect, a system is provided that includes a means for providing a first metal layer including one or more waveguide channels formed into the first metal layer. The system may also include a means for selecting, on the first metal layer, at least one coupling surface proximate to at least edges of the one or more waveguide channels. The system may further include a means for removing an oxidation layer from a second metal layer and from a third metal layer. The system may further include a means for providing a reactive metal foil between a first surface of the first metal layer and a surface of the second metal layer, and between a second surface of the first metal layer and a surface of the third metal layer, the second surface of the first metal layer being opposite the first surface, where the reactive metal foil is provided to the selected at least one coupling surface. The system may still further include a means for providing a fusible metal material between the first surface of the first metal layer and the surface of the second metal layer, and between the second surface of the first metal layer and the surface of the third metal layer, where the fusible metal material is provided to the selected at least one coupling surface. The system may yet still further include a means for coupling the first surface of the first metal layer to the surface of the second metal layer and coupling the second surface of the first metal layer to the surface of the third metal layer, where the couplings comprise igniting the reactive metal foil so as to locally provide heat to the surfaces of the first, second, and third metal layers and melt the fusible metal material, and cooling the melted fusible metal material.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
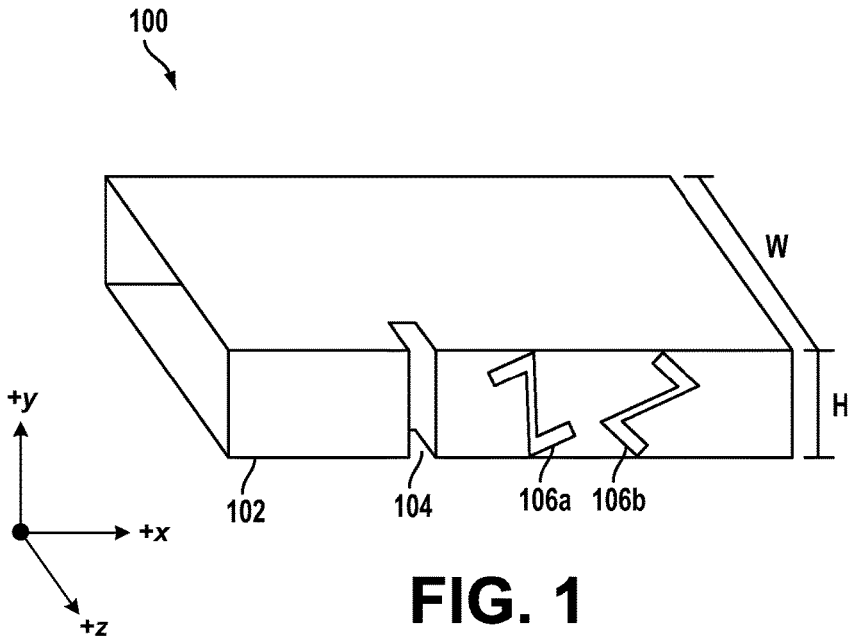
FIG. 1 illustrates an example of radiating slots on a waveguide.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description relates to a method for manufacturing a waveguide antenna, such as an automotive, high-frequency (e.g., 77 GHz) radar antenna used for millimeter electromagnetic wave regions. In practice, waveguide antennas may be fabricated in various ways. For instance, for printed waveguide transmission line (PWTL) antennas, a conductive adhesive thin film can be used to adhere the various layers of the PWTL antennas together. However, the performance of such an antenna may be less than optimal because the radiation efficiency and gain of the antenna is highly dependent on the conductivity of the conductive adhesive layer and its alignment and the time of the laminations.

For this reason, soldering (or metal to metal fusion) may provide better adhesion between metal layers, such as an aluminum sheet metal layer (with copper plating) adhered to copper foil/sheets. Sheet metals may be adhered to other sheet metals rather than foils, in other embodiments. A highly effective soldering process may involve polishing (e.g., by mechanical, chemical, and/or other means) the copper surfaces to remove the oxidation layer, which may facilitate good bonding of the solder (Sn/Pb) to the copper. However, this process may be slow in practice because a new layer of oxidization may emerge on polished surfaces within a short amount of time, and may likely emerge by the time the polished copper surfaces are introduced to solder. One way to mitigate this process may be to deposit a thin protective layer on polished surface which may mask the surface form oxygen. By way of example, the thin protective layer may include sputtered chromate of a thickness of at least a few microns.

Advantageously by this technique, when the solder plating is applied to the sheet metal on top of the copper plating, all copper surfaces may be protected by the protective layer. And when the protective layer is laminated against the solder, the compound that makes up the protective layer (e.g., chromate) may be consumed as part of the soldering/adhesion process. In practice, the adhesion may be achieved by applying cycles of heat and pressure to the layers.

When used for manufacturing waveguide antenna arrays, this technique may combine the normal solder process with selective solder plating areas (e.g., only on the edges of the waveguide channels) and may result in reliable metal-to-metal adhesion. Further, this technique may also involve preparing the surfaces for adhesion using a wetting process by way of which the surfaces are solder wetted to facilitate adhesion. However, even this technique may be improved upon, such as by using a localized foil as a heat source. In particular, it may prove advantageous to use a localized foil as part of the manufacturing process of high-frequency antennas.

After preparing the surfaces of the sheet metal and foil as described above (including the wetting process, and in some embodiments, possibly without the selective solder-plated areas), the sheet metal and foil may be adhered together in a potentially faster and cleaner manner by applying a heat-generating and solder-plated reactive metal foil (such a 40 micron-thin NanoFoil® material produced by Indium Corporation) between the sheet metal and foil and applying very low pressure. Such reactive metal foil may be ignited by a applying a DC voltage, a flame, a spark, etc., which may provide localized high temperature heat relatively quickly (e.g., in a matter of seconds, rather than hours in an oven) and thus may prevent warping. This type of adhesion may also serve to eliminate the pressure and heat cycling that may typically be used in practice, thus avoiding expensive manufacturing facilities such as temperature and pressure enclaves. And by avoiding the typical pressure and heat cycling used for adhesion, the protective layer may not be consumed when heat is applied locally and quickly, and thus more effective adhesion can be achieved.

The reactive metal foil may serve as a source of heat that is localized and placed carefully to avoid heating heat-sensitive areas, and may also be solder-plated, thus avoiding the need to solder plate bulky multiple parts (e.g., for a stack composed of a 0.1" sheet metal sandwiched between two copper 0.005" foils, two foils that are already solder-plated can be used and ignited to complete the process). This may even further simplify the process, possibly making antennas cheaper and more precise to manufacture. In some examples, the reactive metal foil may be fabricated with solder on both surfaces of the reactive metal foil, so that not all metal layers may be subject to the wetting process before the adhesion process is performed.

Within examples, this manufacturing process may be applied to copper foils (or any other types of metallic foils), copper sheets (or any other desired metal sheets), FR-4 type materials that are metallized at certain locations, copper-laminated Kapton® film, or any other circuit board materials with side plating to emulated channels cut in a metallic sheet and bound by metallic sheets. Further, this manufacturing process may also be applied to lower-frequency antennas and to other types of apparatuses as well.

FIGS. 1-4 illustrate example waveguides and radar systems in which example methods of fabrication for waveguides may be implemented.

FIG. 1 illustrates an example of radiating slots (104, 106*a*, 106*b*) on a waveguide 102 in radar unit 100. It should be understood that radar unit 100 presents one possible configuration of radiating slots (104, 106*a*, 106*b*) on a waveguide 102. It should also be understood that a given application of such an antenna may determine appropriate dimensions and sizes for both the radiating slots (104, 106*a*, 106*b*) and the waveguide 102. For instance, as discussed above, some example radar systems may be configured to operate at an electromagnetic wave frequency of 77 GHz, which corresponds to a 3.9 millimeter electromagnetic wave length. At this frequency, the channels, ports, etc. of an apparatus fabricated by way of method 100 may be of given dimensions appropriated for the 77 GHz frequency. Other example antennas and antenna applications are possible as well.

Waveguide 102 of radar unit 100 has a height of H and a width of W. As shown in FIG. 1, the height of the waveguide extends in the Y direction and the width extends in the Z direction. Both the height and width of the waveguide may be chosen based on a frequency of operation for the waveguide 102. For example, when operating waveguide 102 at 77 GHz, the waveguide 102 may be constructed with a height H and width W to allow propagation of 77 GHz wave. An electromagnetic wave may propagate through the waveguide in the X direction. In some examples, the waveguide may have a standard size such as a WR-12 or WR-10. A WR-12 waveguide may support the propagation of electromagnetic waves between 60 GHz and 90 GHz (i.e., between 4.9965 mm and 3.331 mm in wavelength). Additionally, a WR-12 waveguide may have the internal dimensions of approximately 3.1 mm by 1.55 mm. A WR-10 waveguide may support the propagation of electromagnetic waves between 75 GHz and 110 GHz (i.e., between 3.9972 mm and 2.7254 mm in wavelength). Additionally, a WR-12 waveguide may have the internal dimensions of approximately 2.54 mm by 1.27 mm. The dimensions of the WR-12 and the WR-10 waveguides are presented for examples. Other dimensions are possible as well.

Waveguide 102 may be further configured to radiate the electromagnetic energy that is propagating through the waveguide. The radiating slots (104, 106*a*, 106*b*), as shown in FIG. 1, may be located on the surface of the waveguide 102. Additionally, as shown in FIG. 1, the radiating slots (104, 106*a*, 106*b*) may be located primarily on the side of the waveguide 102 with the height H dimension. Further, the radiating slots (104, 106*a*, 106*b*) may be configured to radiate electromagnetic energy in the Z direction.

The linear slot 104 may be a traditional waveguide radiating slot. A linear slot 102 may have a polarization in the same direction as the long dimension of the slot. The long dimension of the linear slot 104, measured in the Y direction, may be approximately one-half of the wavelength of the electromagnetic energy that is propagating through the waveguide. At 77 GHz, the long dimension of the linear slot 104 may be approximately 1.95 mm as a design choice which may make the linear slot resonant. As shown in FIG. 1, the linear slot 104 may have a long dimension that is larger than the height H of the waveguide 102. Thus, the linear slot 104 may be too long to fit on just the side of the waveguide having the height H dimension. The linear slot 104 may continue on to the top and bottom of the waveguide 102. Additionally, a rotation of the linear slot 104 may be adjusted with respect to the orientation of the waveguide. By rotating the linear slot 104, an impedance of the linear slot 104 and a polarization and intensity of the radiation may be adjusted.

Additionally, the linear slot 104 has a width dimension that may be measured in the X direction. Generally, the width of the waveguide may be varied to adjust the bandwidth of the linear slot 104. In many embodiments, the width of the linear slot 104 may be approximately 10% of the wavelength of the electromagnetic energy that is propagating through the waveguide. At 77 GHz, the width of the linear slot 104 may be approximately 0.39 mm. However, the width of the linear slot 104 may be made wider or narrower in various embodiments.

However, in some situations, it may not be practical or possible for a waveguide 102 to have a slot on any side other than the side of the waveguide having the height H dimension. For example, some manufacturing processes may create a waveguide structure in layers. The layers may cause only one side of the waveguide to be exposed to free space. When the layers are created, the top and bottom of the respective waveguide may not be exposed to free space. Thus, a radiating slot that extends to the top and bottom of the waveguide would not be fully exposed to free space, and therefore would not function correctly, in some configurations of the waveguide. Therefore, in some embodiments, folded slots 106*a* and 106*b* may be used to radiate electromagnetic energy from the inside the waveguide.

A waveguide may include slots of varied dimensions, such as folded slots 106*a* and 106*b*, in order to radiate electromagnetic energy. For example, folded slots 106*a* and 106*b* may be used on a waveguide in situations when a half-wavelength sized slot cannot fit on the side of the waveguide. The folded slots 106*a* and 106*b* each may have an associated length and width. The total length of the folded slots 106*a* and 106*b*, as measured through a curve or a bend in the folded slot, may be approximately equal to half the wavelength of the electromagnetic energy in the wave. Thus, at the same operating frequency, the folded slots 106*a* and 106*b* may have approximately the same overall length as the linear slot 104. As shown in FIG. 1, folded slots 106*a* and 106*b* are Z-Slots, as each is shaped like the letter Z. In various embodiments, other shapes may be used as well. For example, both S-Slots and 7-Slots may be used as well (where the slot is shaped like the letter or number it is named after).

The folded slots 106*a* and 106*b* may also each have a rotation. Similarly as described above, a rotation of the folded slots 106*a* and 106*b* may be adjusted with respect to the orientation of the waveguide. By rotating the folded slots 106*a* and 106*b*, an impedance of the folded slots 106*a* and 106*b* and a polarization of the radiation may be adjusted. The radiation intensity may also be varied by such a rotation, which can be used for amplitude tapers for arraying to lower Side Lobe Level (SLL). The SLL will be discussed further with respect to the array structure.

Figure 2:
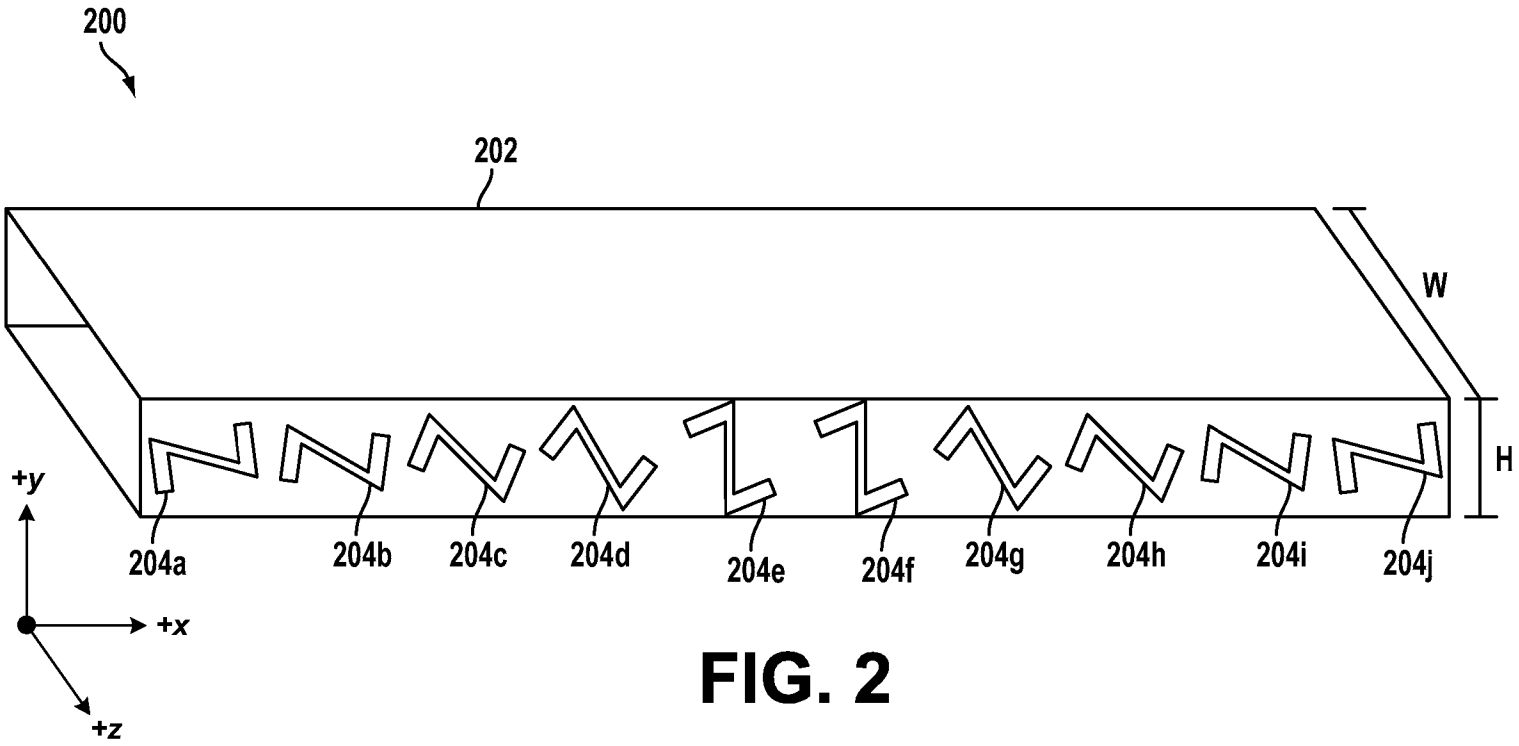
FIG. 2 illustrates an example waveguide with ten radiating Z-Slots.

FIG. 2 illustrates an example waveguide 202 with 10 radiating Z-Slots (204*a*-204*j*) in radar unit 200. As electromagnetic energy propagates down a waveguide 202, a portion of the electromagnetic energy may couple into one or more of the radiating Z-Slots (204*a*-204*j*) on the waveguide 202. Thus, each of the radiating Z-Slots (204*a*-204*j*) on the waveguide 202 may be configured to radiate an electromagnetic signal (in the Z direction). In some instances, each of the radiating Z-Slots (204*a*-204*j*) may have an associated impedance. The impedance for each respective radiating Z-Slot (204*a*-204*j*) may be a function of the both the dimensions of the respective slot and the rotation of the respective slot. The impedance of each respective slot may determine a coupling coefficient for each respective radiating Z-Slot. The coupling coefficient determines a percentage of the electromagnetic energy propagating down a waveguide 202 that is radiated by the respective Z-Slot.

In some embodiments, the radiating Z-Slots (204*a*-204*j*) may be configured with rotations based on a taper profile. The taper profile may specify a given coupling coefficient for each radiating Z-Slots (204*a*-204*j*). Additionally, the taper profile may be chosen to radiate a beam with a desired beamwidth. For example, in one embodiment shown in FIG. 2, in order to obtain the taper profile, the radiating Z-Slots (204*a*-204*j*) may each have an associated rotation. The rotation of each radiating Z-Slot (204*a*-204*j*) may cause the impedance of each slot to be different, and thus cause the coupling coefficient for each radiating Z-Slot (204*a*-204*j*) to correspond to the taper profile. The taper profile of the radiating Z-Slots 204*a*-204*j* of the waveguide 202, as well as taper profiles of other radiating Z-Slots of other waveguides may control a beamwidth of an antenna array that includes a group of such waveguides. The taper profile may also be used to control SLL of the radiation. When an array radiates electromagnetic energy, the energy is generally radiated into a main beam and side lobes. Typically, sidelobes are an undesirable side effect from an array. Thus, the taper profile may be chosen to minimize or reduce the SLL (i.e. the amount of energy radiated in sidelobes) from the array.

Figure 3:
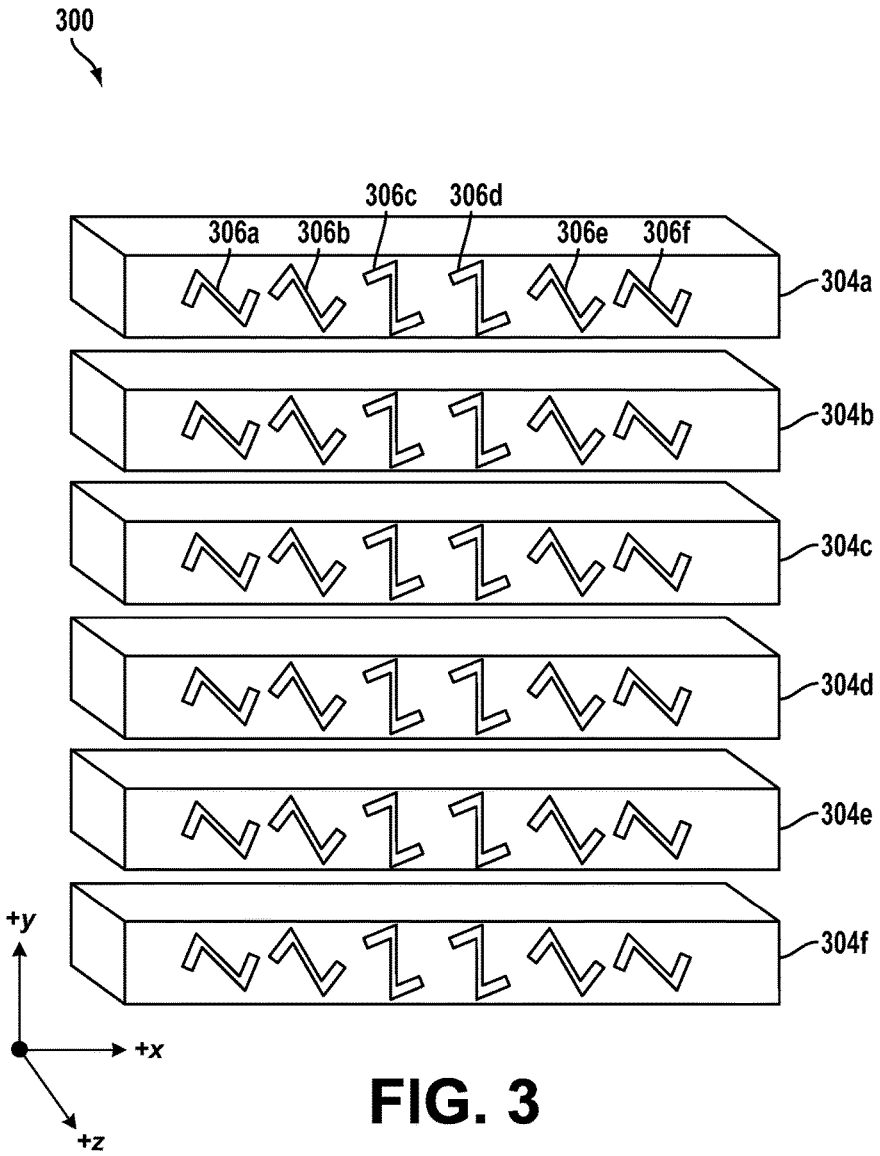
FIG. 3 illustrates an example radar system with six radiating waveguides.
Figure 4:
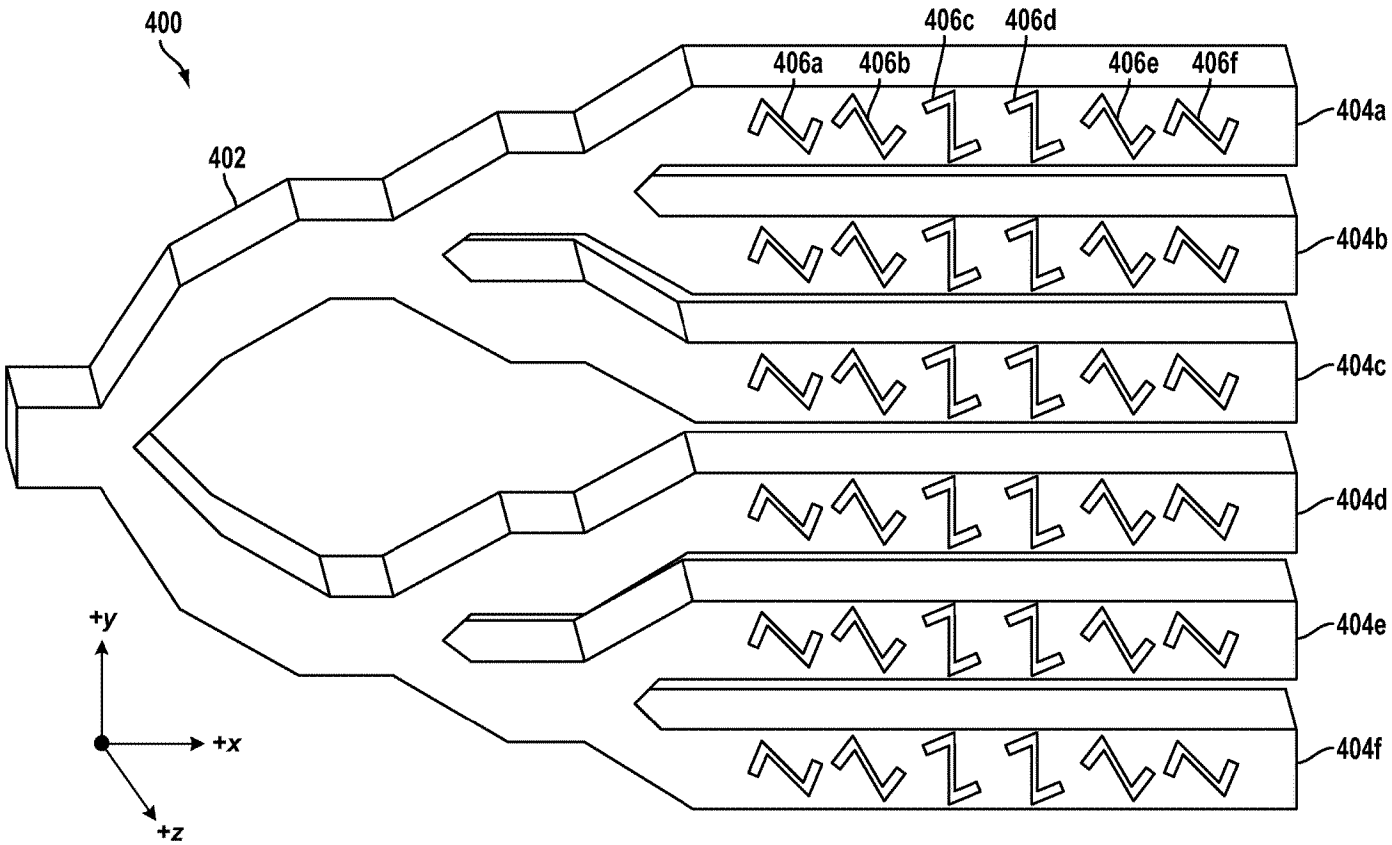
FIG. 4 illustrates an example radar system with six radiating waveguides and a waveguide feed system.

FIG. 3 illustrates an example radar system 300 with six radiating waveguides 304*a*-304*f*. Each of the six radiating waveguides 304*a*-304*f* may have radiating Z-Slots 306*a*-306*f*. Each of the six radiating waveguides 304*a*-304*f* may be similar to the waveguide 202 described with respect to FIG. 2. In some embodiments, a group of waveguides, each containing radiating slots, may be known as an antenna array. The configuration of the six radiating waveguides 304*a*-304*f* of the antenna array may be based on both a desired radiation pattern and a manufacturing process for the radar system 300. Two of the components of the radiation pattern of the radar system 300 include a beam width as well as a beam angle. For example, similar to as discussed with FIG. 2, a taper profile of the radiating Z-Slots 306*a*-306*f* of each of the radiating waveguides 304*a*-304*f* may control a beamwidth of the antenna array. A beamwidth of the radar system 300 may correspond to an angle with respect to the antenna plane (e.g. the X-Y plane) over which a majority of the radar system's radiated energy is directed. Additionally, the beam angle may be controlled by FIG. 4 illustrates an example radar system 400 with six radiating waveguides 404*a*-404*f* and a waveguide feed system 402. The six radiating waveguides 404*a*-404*f* may be similar to the six radiating waveguides 304*a*-304*f* of FIG. 3. In some embodiments, the waveguide feed system 402 may be configured to receive an electromagnetic signal at an input port and divide the electromagnetic signal between the six radiating waveguides 404*a*-404*f*. Thus, the signal that each radiating Z-Slot 406*a*-406*f* of each of the radiating waveguides 404*a*-404*f* radiates may propagate in the X direction through the waveguide feed system. In various embodiments, the waveguide feed system 402 may have different shapes or configurations than that shown in FIG. 4. Based on the shape and configuration of the waveguide feed system 402 various parameters of the radiated signal may be adjusted. For example, a direction and a beamwidth of a radiated beam may be adjusted based on the shape and configuration of the waveguide feed system 402.

Figure 5:
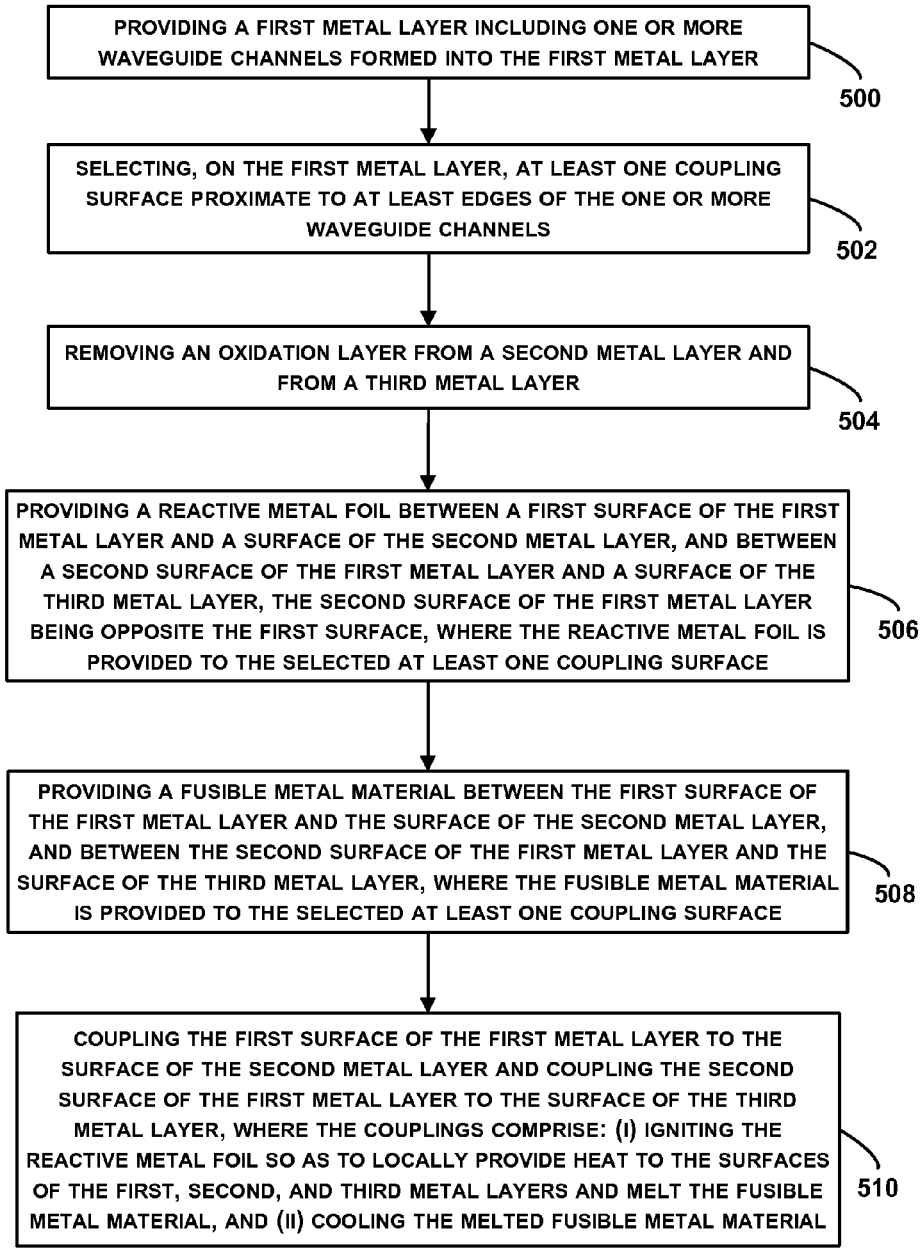
FIG. 5 is an example method for manufacturing an example waveguide antenna.

FIG. 5 is an example method for manufacturing a waveguide antenna, such as a 77 GHz waveguide antenna configured to propagate millimeter electromagnetic waves. Although blocks 500-510 are illustrated in a sequential order, these blocks may also be performed in parallel, and/or in a different order than those described herein. Also, the various blocks may be combined into fewer blocks, divided into additional blocks, and/or removed based upon the desired implementation.

In some embodiments, some shapes and dimensions of a waveguide antenna may be highly convenient to manufacture, though other shapes, dimensions, and methods associated therewith known or not yet known may be implemented with equal or even greater convenience. Various shapes and dimensions of portions of the manufactured waveguide antenna, such as portions of waveguide channels formed in the antenna, including shapes and dimensions other than those described herein, are possible as well. Subsequent and/or intermediate blocks may be involved as well in other embodiments.

Figure 6A:
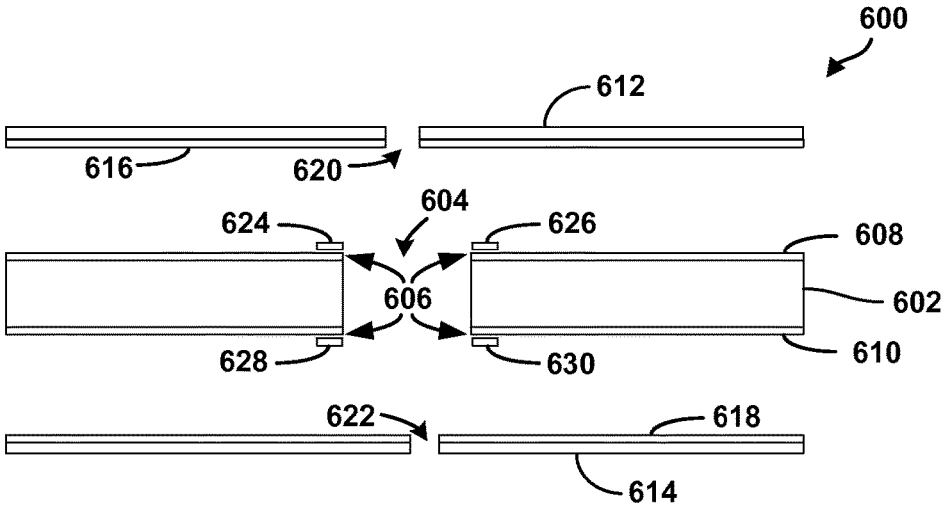
FIG. 6A illustrates an exploded view of a portion of an example waveguide apparatus.
Figure 6B:
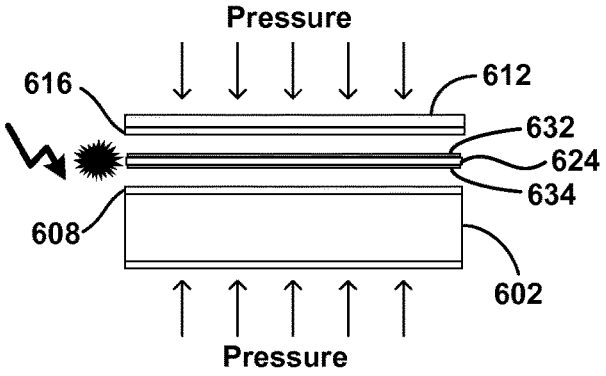
FIG. 6B illustrates an aspect of the example method being performed with respect to the example waveguide of FIG. 6A.

Moreover, aspects of the method of FIG. 5 may be described with reference to FIGS. 1-4 and FIGS. 6A-6B, where FIG. 6A illustrates an exploded view of a portion of an example waveguide apparatus 600 and FIG. 6B illustrates an aspect of the method being performed with respect to the example waveguide apparatus of FIG. 6A.

At block 500, the method includes providing a first metal layer including one or more waveguide channels formed into the first metal layer. Alternatively, the one or more waveguide channels may be formed into the first metal layer after other aspects of the method are performed.

An example first metal layer 602 is shown in FIG. 6A along with a portion of a waveguide channel 604 formed into the first metal layer. Within examples, the one or more waveguide channels formed into the first metal layer may be routing waveguide channels configured to direct electromagnetic waves (e.g., millimeter electromagnetic waves), after the waves enter the waveguide antenna, to various radiating slots, such as the Z-Slots described above. These and/or other waveguide channels formed into the first metal layer may have various shapes and dimensions, such as the dimensions noted above with respect to the waveguide 102 of FIG. 1. By way of example, one or more portions of the waveguide channels may be approximately 2.54 mm by approximately 1.27 mm, in accordance with the internal dimensions described above, where the first metal layer 602 is approximately 2.54 mm thick.

Within examples, the first metal layer may be an aluminum sheet or other metal material. Within other examples, the first metal layer may be plated with another type of conductive material, such as copper. For instance, as shown in FIG. 6A, copper foils 608, 610 may be coupled to the top and bottom surfaces of the first metal layer 602. In other examples, the walls of the waveguide channel may also be plated with a metal material, such as copper (not shown). The copper or other conductive material/foils may have slots (e.g., Z-Slots) machined in them such that those slots may align at least in part with corresponding waveguide channels that are formed in the first metal layer.

In practice, the aluminum sheet may be copper plated before waveguide channels are machined, and the waveguide channels may have exposed aluminum walls that can be plated with copper or another metal if desired. Alternatively, the waveguide channels may be machined into the aluminum sheet first, and then the aluminum sheet may be copper plated. In either processes, the walls of the waveguide channels may be cleaned using a laser scrubbing process or other process. Furthermore, in some embodiments, the aluminum sheet may be plated with nickel at various locations so that the aluminum sheet can then be plated with copper or another metal material at those locations on top of the nickel.

Within other examples, one or more conductive or non-conductive materials may be used instead of a metal layer, such as a dielectric or a dielectric coupled to a polyimide film or a polyimide copper laminate. For instance, a dielectric layer may include FR-4 material, as noted above. FR-4 is a grade designation assigned to glass-reinforced epoxy laminate sheets, tubes, or rods, and FR-4 is a composite material composed of woven fiberglass cloth with an epoxy resin binder that is flame resistant (self-extinguishing) and configured to retain high mechanical values and electrical insulating qualities in both dry and humid conditions. FR-4 glass epoxy is a versatile high-pressure thermoset plastic laminate grade used as an electrical insulator possessing considerable mechanical strength.

Referring back to FIG. 5, at block 502, the method includes selecting, on the first metal layer, at least one coupling surface proximate to at least edges of the one or more waveguide channels. The coupling surface, for instance, may include multiple surfaces on the first metal layer where solder, adhesives, or other coupling materials may be applied to the first metal layer to facilitate adhesion between the first metal layer and other layers of the waveguide antenna.

By way of example, in FIG. 6A, four edges 606 (two on the top of the first metal layer 602 and two on the bottom of the first metal layer) of the waveguide channel 604 may be selected as coupling surfaces.

At block 504, the method includes removing an oxidation layer from a second metal layer and from a third metal layer. The second and/or third metal layers may be copper sheets, for instance, or another type of metal sheet. Further, the second and third metal layers may have the same of different thickness, and may have a substantially less thickness than the first metal layer. By way of example, the second and third metal layers may each have a thickness of approximately 0.127 mm, in comparison to the first metal layer which may have a thickness of 2.54 mm.

Within examples, removing the oxidation layer from the second and third metal layers may involve surface cleaning at least one surface of each of the second and third metal layers. After surface cleaning the second and third layers, the layers can be sanded and/or chemically etched to remove oxides from the cleaned surface(s) of the second and third metal layers.

In some implementations, after the oxidation layer has been removed from the second and third metal layers, a chromium compound such as chromate can be deposited so as to coat one or more surfaces of each of the second and third metal layers. The chromate may be deposited by a sputtering process or other type of process. By depositing the chromate, the resulting chromate coating may protect the one or more surfaces of the second and third metal layers from oxygen. Advantageously, in some scenarios, such a chromate coating may be consumed during adhesion of the second and third metal layers to the first metal layer, thus allowing the second and third metal layers to adhere to the first metal layer (e.g., a reliable copper-to-copper solder joint). In some scenarios, such adhesion may be implemented without thin conductive adhesive films between the first, second, and third metal layers. Other materials may be used as well to protect the second and third metal layers from oxygen, in addition to or alternative to chromate.

An example second metal layer 612 and an example third metal layer 614 are shown in FIG. 6A. Further, the second metal layer 612 may include a chromate layer 616 on a bottom surface of the second metal layer. Still further, the third metal layer 614 may include a chromate layer 618 on a top surface of the third metal layer.

In some embodiments, at least a portion of the one or more waveguide channels may be formed into at least one of the second and third metal layers. For instance, a first portion of the one or more waveguide channels may be formed into the first metal layer, whereas a second portion and third portion of the one or more waveguide channels may be formed into the second and third metal layers, respectively, where the second and third portions may or may not be identical. In such embodiments, when the first, second, and third layers are coupled together, the layers may be coupled together such that the portions of the one or more waveguide channels of the second and/or third layers are substantially aligned with the first portion of the one or more waveguide channels of the first metal layer, thus forming one or more waveguide channels in the waveguide antenna that may be configured to propagate electromagnetic waves (e.g., millimeter electromagnetic waves).

In other embodiments, the one or more waveguide channels may be formed entirely in the first metal layer. In such other embodiments, the second and third metal layers may include other elements that may be configured to facilitate radiation of electromagnetic waves. For instance, as shown in FIG. 6A, the second metal layer may include a radiating element 620, such as a radiating element that comprises a slot configured to radiate electromagnetic waves out of the waveguide apparatus 600, such as millimeter electromagnetic waves. The slot may have a rotational orientation relative to a dimension of the one or more waveguide channels. For example, the slot may be a Z-Slot or another type of slot.

Furthermore, the third metal layer 614 may include an input port 622 configured to receive electromagnetic waves into the waveguide apparatus 600, which may then be propagated through the one or more waveguide channels 604 and radiated out the radiating element 620. Although the input port 622 is illustrated to be directly below the radiating element 620, it should be understood that, in some embodiments, that the input port 622 may be located elsewhere in the third metal layer 614 with respect to the radiating element 620 and not located directly below the radiating element.

Referring back to FIG. 5, at block 506, the method includes providing a reactive metal foil between a first surface of the first metal layer and a surface of the second metal layer, and between a second surface of the first metal layer and a surface of the third metal layer, the second surface of the first metal layer being opposite the first surface, where the reactive metal foil is provided to the selected at least one coupling surface.

The reactive metal foil, such as NanoFoil®, may include one or more reactive metals (i.e., metals that undergo a chemical reaction when exposed to elements such as oxygen, hydrogen, or nitrogen). Such reactive metals may include aluminum, nickel, titanium, silicon, and magnesium. The reactive metal foil may be any type of foil comprised of components that may react to a burst of igniting heat, electrolysis, or other processes that cause reaction.

In some implementations, the reactive metal foil may be provided to only edges of the one or more waveguide channels. In other implementations, however, the reactive metal foils may be provided at other locations between the first, second, and third metal layers.

As shown in FIG. 6A, two reactive metal foils 624, 626 may be provided to two of the four selected coupling surfaces 606, between the top surface of the first metal layer 602 and the bottom surface of the second metal layer 612 (i.e., between the copper foil 608 plating of the first metal layer and the chromate layer 616 of the second metal layer). And two other reactive metal foils 628, 630 may be provided to the other two of the four selected coupling surfaces 606, between the bottom surface of the first metal layer 602 and the top surface of the third metal layer 614 (i.e., between the copper foil 610 plating of the first metal layer and the chromate layer 618 of the third metal layer). In some implementations, reactive metal foils provided to some coupling surfaces may have a different thickness than other reactive metal foils provided to other coupling surfaces. The reactive metal foil could, for example, have a thickness between 40 micrometers and 150 micrometers, although thicknesses outside of this range are possible as well.

At block 508, the method includes providing a fusible metal material between the first surface of the first metal layer and the surface of the second metal layer, and between the second surface of the first metal layer and the surface of the third metal layer, where the fusible metal material is provided to the selected at least one coupling surface. In some implementations, the fusible metal material (e.g., solder) may be provided such that the reactive metal foils are coated with the fusible metal material. For instance, reactive metal foils that are plated with solder may be provided between the first, second, and third metal layers. In other implementations, the fusible metal material may be provided separately from the reactive metal foils (e.g., applying solder after providing the reactive metal foils rather than providing reactive metal foils that are solder-plated). In still other implementations, the fusible metal material may be provided along with reactive metal foils that are plated with the same or other fusible metal material.

Similar to the reactive metal foil, in some implementations, the fusible metal material may be provided to only edges of the one or more waveguide channels. In other implementations, however, the fusible metal material may be provided at other locations between the first, second, and third metal layers. For instance, when the surface areas are large and there are large portions of the layers that do not include waveguide channels (e.g., flat surfaces with no waveguide channels formed into them), it may be desirable to achieve bonding between these large portions to corresponding surfaces of other layers of the waveguide antenna, which may provide a uniform layer-to-layer adhesion. Thus, fusible metal material may be provided to such large portions on the first, second, and/or third metal layers to prevent warping and bulging.

In an example implementation, fusible metal material may be selectively provided to surfaces of the first metal layer that are within approximately 0.762 mm of the rims/edges of the one or more waveguide channels. Fusible metal material may be provided by way of masking, stenciling, or other processes, followed by removal of excess fusible metal material if necessary. In other implementations, as noted above, reactive metal foils that are plated with fusible metal material may be used as an alternative to selectively providing fusible metal material.

At block 510, the method includes coupling the first surface of the first metal layer to the surface of the second metal layer and coupling the second surface of the first metal layer to the surface of the third metal layer, where the couplings comprise (i) igniting the reactive metal foil so as to locally provide heat to the surfaces of the first, second, and third metal layers and melt the fusible metal material, and (ii) cooling the melted fusible metal material.

FIG. 6B illustrates an example scenario where a reactive metal foil is ignited to facilitate adhesion of two metal layers. In particular, FIG. 6B illustrates the reactive metal foil 624 of FIG. 6A being ignited between the first metal layer 602 and the second metal layer 612 of the waveguide apparatus 600.

In practice, while applying pressure to the first metal layer 602 and the second metal layer 612, a heat pulse can be initiated at the reactive metal foil 624. The heat pulse may be delivered by a bridge wire, a laser, an electric spark, a flame, a DC voltage, or by other means. By applying the heat pulse, the metal(s) of the reactive metal foil may undergo a self-sustaining exothermic reaction, which may occur in a solid and liquid phase only without releasing gas. The resulting exothermic reaction may locally heat surfaces of the first metal layer 602 and the second metal layer 612, including surfaces at a location where the first and second metal layers contact the reactive metal foil 624, and possibly including surfaces proximate to that location. The locally-applied heat may be delivered uniformly to these surfaces.

The locally-applied heat may thus cause fusible metal material proximate to the reactive metal foil to melt. As noted above, the fusible metal material may already be coating the reactive metal foil 624 at the time of ignition (e.g., a reactive metal foil that is pre-coated with solder) and/or may be applied separately to surfaces of the first metal layer 602 and the second metal layer 612. As shown in FIG. 6B, the reactive metal foil 624 is coated with solder layers 632 and 634.

In addition, when the heat is applied, the chromate layer 616 of the second metal layer 612 may be consumed, thereby protecting the second metal layer from oxygen before the second metal layer is adhered to the first metal layer 602. Such a heating process may be used to avoid pressure and heat cycling using an oven and pressure-delivering devices. After the reactive metal foil 624 has been ignited and the heat has been locally applied, the melted fusible metal material may then cool to complete the adhesion.

The pressure applied to the apparatus 600 when coupling the layers and igniting the reactive metal foil may be constant throughout the adhesion processes or may vary throughout. For example, in some implementations, constant low pressure may be sufficient for reliably adhering the layers together. In other implementations, high pressure may be desirable at at least one point in time during the adhesion process. Further, pressure may be applied to the apparatus 600 using machinery or other methods of applying pressure.

For example, pressure may be applied to the apparatus 600 by hand. Other examples are also possible.

It should be understood that various processes, including but not limited to those described above, may be involved in preparing the first, second, third, and/or additional layers for adhesion to corresponding contact points of other layers/materials. For instance, as noted above, surfaces of these layers that are to be adhered to other surfaces may be solder wetted. Further, flux may be applied to various surfaces of the layers before applying solder. Still further, various surfaces may be chemically or mechanically polished before adhesion.

It should also be understood that arrangements described herein are for purposes of example only. As such, those skilled in the art will appreciate that other arrangements and other elements (e.g. machines, apparatuses, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A method of manufacturing a waveguide antenna comprising:

providing a first metal layer including one or more waveguide channels formed into the first metal layer, wherein the first metal layer is a sheet of metal having a predefined thickness;

selecting, on the first metal layer, at least one coupling surface proximate to at least edges of the one or more waveguide channels;

removing an oxidation layer from a second metal layer and from a third metal layer;

providing a reactive metal foil between a first surface of the first metal layer and a surface of the second metal layer, and between a second surface of the first metal layer and a surface of the third metal layer, the second surface of the first metal layer being opposite the first surface, wherein the reactive metal foil is provided to the selected at least one coupling surface;

providing a fusible metal material between the first surface of the first metal layer and the surface of the second metal layer, and between the second surface of the first metal layer and the surface of the third metal layer, wherein the fusible metal material is provided to the selected at least one coupling surface; and coupling the first surface of the first metal layer to the surface of the second metal layer and coupling the second surface of the first metal layer to the surface of the third metal layer, wherein the couplings comprise:

igniting the reactive metal foil so as to locally provide heat to the surfaces of the first, second, and third metal layers and melt the fusible metal material, and cooling the melted fusible metal material.

2. The method of claim 1, wherein the waveguide antenna is configured to operate at 77 Gigahertz (GHz) and propagate millimeter (mm) electromagnetic waves.

3. The method of claim 1, wherein the fusible metal material and the reactive metal foil are provided to only the edges of the one or more waveguide channels.

4. The method of claim 1, further comprising:

forming, into at least one of the second metal layer and the third metal layer, at least a portion of one or more waveguide channels, wherein coupling the first surface of the first metal layer to the surface of the second metal layer and coupling the second surface of the first metal layer to the surface of the third metal layer includes coupling the first, second, and third metal layers such that the one or more waveguide channels of the first metal layer are substantially aligned with the one or more waveguide channels formed into at least one of the second metal layer and the third metal layer so as to form one or more waveguide channels in the waveguide antenna configured to propagate millimeter (mm) electromagnetic waves.

5. The method of claim 1, further comprising:

after removing the oxidation layer from the second and third metal layers, depositing a chromate coating to the surface of the second metal layer and to the surface of the third metal layer, the chromate coating being effective to protect the surface of the second metal layer and the surface of the third metal layer from oxygen.

6. The method of claim 1, wherein providing the fusible metal material comprises providing the fusible metal material to the reactive metal foil so as to coat the reactive metal foil with the fusible metal material.

7. The method of claim 1, wherein the waveguide antenna has dimensions corresponding to a height and a depth, the height being less than the depth, wherein the waveguide antenna comprises a radiating element, wherein the radiating element comprises a slot configured to radiate millimeter electromagnetic waves, and wherein the slot has a rotational orientation relative to a dimension of the one or more waveguide channels.

8. The method of claim 7, wherein the slot is defined by an angular path having a Z-shape, wherein the Z-shape includes a center portion and two arms, wherein each arm is connected to the center portion at opposing ends of the center portion.

9. The method of claim 1, wherein the first metal layer is an aluminum sheet that is thicker than the second and third metal layers, and wherein the second and third metal layers are copper sheets.

10. The method of claim 1, wherein the reactive metal foil includes one or more of aluminum, nickel, titanium, silicon, and magnesium.

11. A waveguide antenna comprising:

a first metal layer including (i) one or more waveguide channels formed into the first metal layer and (ii) at least one coupling surface proximate to at least edges of the one or more waveguide channels, wherein the first metal layer is a sheet of metal having a predefined thickness;

a second metal layer and a third metal layer, each with respective oxidation layers removed;

a reactive metal foil that is (i) provided to the at least one coupling surface, (ii) located between a first surface of the first metal layer and a surface of the second metal layer, and (iii) located between a second surface of the first metal layer and a surface of the third metal layer, the second surface of the first metal layer being opposite the first surface;

a fusible metal material that is (i) provided to the at least one coupling surface, (ii) located between the first surface of the first metal layer and the surface of the second metal layer, and (iii) located between the second surface of the first metal layer and the surface of the third metal layer; and wherein the first surface of the first metal layer is coupled to the surface of the second metal layer and the second surface of the first metal layer is coupled to the surface of the third metal layer by:

igniting the reactive metal foil so as to locally provide heat to the surfaces of the first, second, and third metal layers and melt the fusible metal material, and cooling the melted fusible metal material.

12. The waveguide antenna of claim 11, wherein the waveguide antenna is configured to operate at 77 Gigahertz (GHz) and propagate millimeter (mm) electromagnetic waves.

13. The waveguide antenna of claim 11, wherein the fusible metal material and the reactive metal foil are provided to only the edges of the one or more waveguide channels.

14. The waveguide antenna of claim 11, wherein at least one of the second metal layer and the third metal layer each include at least a portion of one or more waveguide channels, wherein the first surface of the first metal layer is coupled to the surface of the second metal layer and the second surface of the first metal layer is coupled to the surface of the third metal layer such that the one or more waveguide channels of the first metal layer are substantially aligned with the one or more waveguide channels formed into at least one of the second metal layer and the third metal layer so as to form one or more waveguide channels in the waveguide antenna configured to propagate millimeter (mm) electromagnetic waves.

15. The waveguide antenna of claim 11, wherein the surface of the second metal layer and the surface of the third metal layer each include a deposited chromate coating, the deposited chromate coating being effective to protect the surface of the second metal layer and the surface of the third metal layer from oxygen.

16. The waveguide antenna of claim 11, wherein the fusible metal material being provided to the at least one coupling surface comprises providing the fusible metal material to the reactive metal foil so as to coat the reactive metal foil with the fusible metal material.

17. The waveguide antenna of claim 11, wherein the waveguide antenna has dimensions corresponding to a height and a depth, the height being less than the depth, wherein the waveguide antenna comprises a radiating element, wherein the radiating element comprises a slot configured to radiate millimeter electromagnetic waves, and wherein the slot has a rotational orientation relative to a dimension of the one or more waveguide channels.

18. The waveguide antenna of claim 17, wherein the slot is defined by an angular path having a Z-shape, wherein the Z-shape includes a center portion and two arms, wherein each arm is connected to the center portion at opposing ends of the center portion.

19. The waveguide antenna of claim 11, wherein the first metal layer is an aluminum sheet that is thicker than the second and third metal layers, and wherein the second and third metal layers are copper sheets.

20. The waveguide antenna of claim 11, wherein the reactive metal foil includes one or more of aluminum, nickel, titanium, silicon, and magnesium.

21. The method of claim 1, wherein the predefined thickness is at least as thick as a height of the one or more waveguide channels.

22. The waveguide antenna of claim 11, wherein the predefined thickness is at least as thick as a height of the one or more waveguide channels.

* * * * *